US009816277B2

(12) United States Patent
Mollinger et al.

(10) Patent No.: US 9,816,277 B2
(45) **Date of Patent: *Nov. 14, 2017**

(54) BACKED PANEL AND SYSTEM FOR CONNECTING BACKED PANELS

(71) Applicant: Royal Building Products (USA) Inc., Atlanta, GA (US)

(72) Inventors: Paul J. Mollinger, Blacklick, OH (US); Paul R. Pelfrey, Wheelersburg, OH (US); Larry R. Fairbanks, Columbus, OH (US)

(73) Assignee: Royal Building Products (USA) Inc., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/073,074

(22) Filed: Mar. 17, 2016

(65) Prior Publication Data

US 2016/0194881 A1 Jul. 7, 2016

Related U.S. Application Data

(63) Continuation of application No. 13/221,391, filed on Aug. 30, 2011, now Pat. No. 9,309,678, which is a (Continued)

(51) Int. Cl.
*E04F 13/08* (2006.01)
*E04F 13/18* (2006.01)
(Continued)

(52) U.S. Cl.
CPC ..... *E04F 13/0864* (2013.01); *E04F 13/0876* (2013.01); *E04F 13/16* (2013.01);
(Continued)

(58) Field of Classification Search
CPC . E04F 13/16; E04F 13/24; E04F 13/26; E04F 13/18; E04F 13/0876; E04F 13/0864; E04D 3/35
See application file for complete search history.

(56) References Cited

U.S. PATENT DOCUMENTS 1,589,675 A 6/1926 Belding
1,728,394 A 9/1929 Cornell et al.
(Continued)

FOREIGN PATENT DOCUMENTS

CA 96829 8/2002
CA 2267000 4/2003
(Continued)

OTHER PUBLICATIONS

Sweet's General Building & Renovation, 1995 Catalog File; section 07460 on Siding, pp. 4-20.
(Continued)

*Primary Examiner* — Jeanette E Chapman
(74) *Attorney, Agent, or Firm* — Standley Law Group LLP

(57) ABSTRACT

A backed panel comprising a facing panel and a backing panel. The backing panel has a groove, recessed portion, or any other suitable type of relief channel adapted to receive a side edge portion of a facing panel of an adjacent backed panel. By providing a space to receive a side edge portion of an adjacent facing panel, the relief channel may enable an improved lap joint to be established between adjacent backed panels.

36 Claims, 8 Drawing Sheets

Related U.S. Application Data continuation of application No. 11/233,929, filed on Sep. 23, 2005, now Pat. No. 8,006,455.

(51) Int. Cl.

| | |
|---|---|
| ***E04F 13/16*** | (2006.01) |
| ***E04F 13/24*** | (2006.01) |
| ***E04F 13/26*** | (2006.01) |
| *E04D 3/35* | (2006.01) |

(52) U.S. Cl.

CPC ..... *E04F 13/18* (2013.01); *E04F 13/24* (2013.01); *E04F 13/26* (2013.01); *E04D 3/35* (2013.01)

(56) References Cited

U.S. PATENT DOCUMENTS 1,882,529 A 10/1932 Thulin
2,085,764 A * 7/1937 Odell ..... E04F 13/147 52/314
2,308,789 A 2/1940 Stagg
2,192,933 A 3/1940 Saborsky et al.
2,264,961 A 12/1941 Ward
2,615,210 A 10/1952 Washburn et al.
2,830,546 A 4/1958 Rippe et al.
2,961,804 A 11/1960 Beckman
3,004,483 A 10/1961 Prager et al.
3,001,332 A 11/1961 Wilder
D196,230 S 9/1963 Raftery
3,110,130 A 11/1963 Trachtenberg
3,158,960 A 12/1964 Newton et al.
3,159,943 A 12/1964 Sugar et al.
3,233,382 A 2/1966 Graveley, Jr.
3,246,436 A 4/1966 Roush
3,284,980 A 11/1966 Dinkel
3,289,365 A 12/1966 McLaughlin et al.
3,289,371 A 12/1966 Pearson et al.
3,289,380 A 12/1966 Charniga, Jr.
3,304,678 A 2/1967 Morell
3,308,586 A 3/1967 Olson
3,325,952 A 6/1967 Trachtenberg
D208,251 S 8/1967 Facer
3,347,009 A 10/1967 Meddick
3,387,418 A 6/1968 Tyrer
3,399,916 A 9/1968 Ensor
3,468,086 A * 9/1969 Warner ..... E04D 3/355 156/202
3,473,274 A 10/1969 Godes
3,520,099 A 7/1970 Mattes
3,552,078 A 1/1971 Mattes
3,555,762 A 1/1971 Costanzo, Jr.
3,608,261 A 9/1971 French et al.
3,637,459 A 1/1972 Parish et al.
3,703,795 A 11/1972 Mattes
3,742,668 A 7/1973 Oliver
3,807,113 A 4/1974 Turner
3,815,310 A 6/1974 Kessier
3,826,054 A 7/1974 Culpepper, Jr.
3,868,300 A 2/1975 Wheeler
3,887,410 A 6/1975 Lindner
3,895,087 A 7/1975 Ottinger et al.
3,941,632 A 3/1976 Swedenberg et al.
3,944,698 A 3/1976 Dierks et al.
3,969,866 A 7/1976 Kyne
3,970,502 A 7/1976 Turner
3,973,369 A 8/1976 Smith
3,993,822 A 11/1976 Knauf et al.
3,998,021 A 12/1976 Lewis
4,001,997 A 1/1977 Saltzman
4,015,391 A 4/1977 Epstein et al.
4,033,802 A 7/1977 Culpepper, Jr.
4,034,528 A 7/1977 Sanders et al.
4,048,101 A 9/1977 Nakamachi et al.
4,065,333 A 12/1977 Lawlis et al.
4,073,997 A 2/1978 Richards et al.
4,081,939 A 4/1978 Culpepper, Jr. et al.
4,096,011 A 6/1978 Sanders et al.
4,100,711 A 7/1978 Skuran
4,102,106 A 7/1978 Golder et al.
4,104,841 A 8/1978 Naz
4,109,041 A 8/1978 Tellman
4,118,166 A 10/1978 Bartrum
4,154,040 A 5/1979 Pace
4,181,767 A 1/1980 Steinau
4,188,762 A 2/1980 Tellman
4,189,885 A 2/1980 Fritz
4,242,406 A 12/1980 Bouhnini et al.
4,244,353 A 1/1981 Straza
4,272,576 A 6/1981 Britson
4,274,236 A 6/1981 Kessler
4,277,526 A 7/1981 Jackson
4,279,106 A 7/1981 Gleason et al.
4,288,959 A 9/1981 Murdock
4,296,169 A 10/1981 Shannon
4,303,722 A 12/1981 Pilgrim
4,319,439 A 3/1982 Gussow
4,320,613 A 3/1982 Kaufman
4,327,528 A 5/1982 Fritz
4,335,177 A 6/1982 Takeuchi
4,351,867 A 9/1982 Mulvey et al.
4,361,616 A 11/1982 Bomers
4,366,197 A 12/1982 Hanlon et al.
4,389,824 A 6/1983 Anderson
4,399,643 A 8/1983 Hafner
4,424,655 A 1/1984 Trostle
4,429,503 A 2/1984 Holliday
4,437,274 A 3/1984 Slocum et al.
4,450,665 A 5/1984 Katz
D274,947 S 7/1984 Culpepper, Jr. et al.
4,468,909 A 9/1984 Eaton
4,477,300 A 10/1984 Pilgrim
4,492,064 A 1/1985 Bynoe
4,504,533 A 3/1985 Altenhofer et al.
4,506,486 A 3/1985 Culpepper, Jr. et al.
4,586,304 A 5/1986 Flamand
4,593,512 A 6/1986 Funaki
4,608,800 A 9/1986 Fredette
4,637,860 A 1/1987 Harper et al.
4,647,496 A 3/1987 Lehnert
4,649,008 A 3/1987 Johnstone et al.
4,680,911 A 7/1987 Davis et al.
D291,249 S 8/1987 Manning
4,694,628 A 9/1987 Vondergoltz et al.
4,709,519 A 12/1987 Liefer et al.
4,716,645 A 1/1988 Pittman et al.
4,722,866 A 2/1988 Wilson et al.
4,782,638 A 11/1988 Hovind
4,788,808 A 12/1988 Slocum
4,810,569 A 3/1989 Lehnert et al.
4,814,413 A 3/1989 Thibaut et al.
4,843,790 A 7/1989 Taravella
4,856,975 A 8/1989 Gearhart
4,864,788 A 9/1989 Tippmann
4,911,628 A 3/1990 Heilmayr et al.
4,920,709 A 5/1990 Garries et al.
4,930,287 A 6/1990 Volk et al.
4,955,169 A 9/1990 Shisko
4,962,622 A 10/1990 Albrecht et al.
4,969,302 A * 11/1990 Coggan ..... E04F 13/0864 52/309.8
D316,299 S 4/1991 Hurlburt
5,016,415 A 5/1991 Kellis
5,022,204 A 6/1991 Anderson
5,022,207 A 6/1991 Hartnett
5,024,045 A 6/1991 Fluent et al.
5,050,357 A 9/1991 Lawson
5,060,426 A 10/1991 Jantzen
5,060,444 A 10/1991 Paquette
5,080,950 A 1/1992 Burke
5,090,174 A 2/1992 Fragale
5,094,058 A 3/1992 Slocum
5,103,612 A 4/1992 Wright
5,220,762 A 6/1993 Lehnert et al.

(56) References Cited

U.S. PATENT DOCUMENTS 5,224,315 A 7/1993 Winter, IV
5,230,377 A 7/1993 Berman
D342,579 S 12/1993 Mason
5,282,344 A 2/1994 Moore
5,283,102 A 2/1994 Sweet et al.
5,303,525 A 4/1994 Magee
5,306,548 A 4/1994 Zabrocki et al.
5,318,737 A 6/1994 Trabert et al.
5,319,900 A 6/1994 Lehnert et al.
5,347,784 A 9/1994 Crick et al.
5,353,560 A 10/1994 Heydon
5,363,623 A 11/1994 King
5,371,989 A 12/1994 Lehnert et al.
5,387,381 A 2/1995 Saloom
5,394,672 A 3/1995 Seem
5,415,921 A 5/1995 Grohman
D361,138 S 8/1995 Moore et al.
5,443,878 A 8/1995 Treloar et al.
5,461,839 A 10/1995 Beck
5,465,486 A 11/1995 King
5,465,543 A 11/1995 Seifert
5,475,963 A 12/1995 Chelednik
5,482,667 A 1/1996 Dunton et al.
5,501,056 A 3/1996 Hannah et al.
5,502,940 A 4/1996 Fifield
5,522,199 A 6/1996 Pearce
5,537,791 A 7/1996 Champagne
5,542,222 A 8/1996 Wilson et al.
5,548,940 A 8/1996 Baldock
5,551,204 A 9/1996 Mayrand
5,560,170 A 10/1996 Ganser et al.
5,564,246 A 10/1996 Champagne
5,565,056 A 10/1996 Lause et al.
5,575,127 A 11/1996 O'Neal
5,581,970 A 12/1996 O'Shea
5,586,415 A 12/1996 Fisher et al.
5,598,677 A 2/1997 Rehm, III
5,601,888 A 2/1997 Fowler
5,613,337 A 3/1997 Plath et al.
5,622,020 A 4/1997 Wood
5,634,314 A 6/1997 Champagne
5,636,489 A 6/1997 Leverrier et al.
5,644,880 A 7/1997 Lehnert et al.
5,651,227 A 7/1997 Anderson
5,661,939 A 9/1997 Coulis et al.
5,662,977 A 9/1997 Spain et al.
5,664,376 A 9/1997 Wilson et al.
5,671,577 A 9/1997 Todd
5,675,955 A 10/1997 Champagne
5,678,367 A 10/1997 Kline
5,694,728 A 12/1997 Heath, Jr. et al.
5,704,172 A 1/1998 Gougeon et al.
5,704,179 A 1/1998 Lehnert et al.
5,720,114 A 2/1998 Guerin
5,729,946 A 3/1998 Beck
5,737,881 A 4/1998 Stocksieker
5,765,333 A 6/1998 Cunningham
5,768,844 A 6/1998 Grace, Sr. et al.
5,772,846 A 6/1998 Jaffee
5,784,848 A 7/1998 Toscano
5,791,093 A 8/1998 Diamond
5,791,109 A 8/1998 Lehnert et al.
5,799,446 A 9/1998 Tamlyn
5,806,185 A 9/1998 King
5,809,731 A 9/1998 Reiss
5,829,206 A 11/1998 Bachman
5,836,113 A 11/1998 Bachman
D402,770 S 12/1998 Hendrickson et al.
5,857,303 A 1/1999 Beck et al.
5,858,522 A 1/1999 Turk et al.
5,860,259 A 1/1999 Laska
5,866,054 A 2/1999 Dorchester et al.
5,866,639 A 2/1999 Dorchester et al.
5,869,176 A 2/1999 Dorchester et al.
5,878,543 A 3/1999 Mowery
5,881,502 A 3/1999 Tamlyn
5,945,182 A 8/1999 Fowler et al.
5,946,876 A 9/1999 Grace, Sr. et al.
5,956,914 A 9/1999 Williamson
5,960,598 A 10/1999 Tamlyn
5,974,756 A 11/1999 Alvarez et al.
5,981,406 A 11/1999 Randall
6,018,924 A 2/2000 Tamlyn
6,029,415 A * 2/2000 Culpepper ..... E04F 13/0864 52/522
6,035,587 A 3/2000 Dressler
6,047,507 A 4/2000 Lappin et al.
6,050,041 A 4/2000 Mowery et al.
6,086,997 A 7/2000 Patel et al.
D429,009 S 8/2000 Ginzel
6,122,877 A 9/2000 Hendrickson et al.
6,161,354 A 12/2000 Gilbert et al.
6,185,891 B1 2/2001 Moore
6,187,424 B1 2/2001 Kjellqvist et al.
6,195,952 B1 3/2001 Culpepper et al.
6,223,488 B1 5/2001 Pelfrey et al.
6,228,507 B1 5/2001 Hahn
6,233,890 B1 5/2001 Tonyan
6,263,574 B1 7/2001 Lubker, II et al.
6,272,797 B1 8/2001 Finger
6,276,107 B1 8/2001 Waggoner et al.
D447,820 S 9/2001 Grace
6,282,858 B1 9/2001 Swick
D448,865 S 10/2001 Manning
6,295,777 B1 10/2001 Hunter et al.
D450,138 S 11/2001 Barber
6,321,500 B1 11/2001 Manning et al.
6,336,988 B1 1/2002 Enlow et al.
6,348,512 B1 2/2002 Adriani
D454,962 S 3/2002 Grace
6,358,585 B1 3/2002 Wolff
6,360,508 B1 3/2002 Pelfrey et al.
6,363,676 B1 4/2002 Martion, III
6,367,220 B1 4/2002 Krause et al.
6,367,222 B1 4/2002 Timbrel et al.
6,393,792 B1 5/2002 Mowery et al.
6,418,610 B2 7/2002 Lubker, II et al.
6,442,912 B1 9/2002 Phillips et al.
6,516,577 B2 2/2003 Pelfrey et al.
6,516,578 B1 2/2003 Hunsaker
D471,292 S 3/2003 Barber
6,526,718 B2 3/2003 Manning et al.
6,539,675 B1 4/2003 Gile
6,594,965 B2 7/2003 Coulton
6,625,939 B1 9/2003 Beck et al.
D481,804 S 11/2003 Pelfrey
6,673,868 B2 1/2004 Choulet
6,684,597 B1 2/2004 Butcher
6,716,522 B2 4/2004 Matsumoto et al.
6,752,941 B2 6/2004 Hills
6,784,230 B1 8/2004 Patterson et al.
6,824,850 B2 11/2004 Nourigat
6,865,849 B1 3/2005 Mollinger et al.
6,886,301 B2 5/2005 Schilger
6,971,211 B1 12/2005 Zehner
6,979,189 B2 12/2005 Baxter et al.
6,988,345 B1 1/2006 Pelfrey et al.
7,040,067 B2 5/2006 Mowery et al.
7,188,454 B2 3/2007 Mowery et al.
7,204,062 B2 4/2007 Fairbanks et al.
7,281,358 B2 10/2007 Floyd
7,331,150 B2 2/2008 Martinique
7,467,500 B2 12/2008 Fairbanks et al.
7,908,814 B2 3/2011 Wilson et al.
8,006,455 B1 8/2011 Mollinger et al.
8,387,325 B2 * 3/2013 Mullet ..... E04F 13/075 52/526
2001/0023565 A1 9/2001 Snider et al.
2001/0041256 A1 11/2001 Heilmayr
2002/0018907 A1 2/2002 Zehner
2002/0020125 A1 2/2002 Pelfrey et al.
2002/0025420 A1 2/2002 Wanat et al.
2002/0029537 A1 3/2002 Manning et al.
2002/0054996 A1 5/2002 Van Rheenen

(56) References Cited

U.S. PATENT DOCUMENTS

| | | | |
|---|---|---|---|
| 2002/0056244 | A1 | 5/2002 | Hertweck |
| 2002/0076544 | A1 | 6/2002 | DeWorth et al. |
| 2002/0078650 | A1 | 6/2002 | Bullinger et al. |
| 2002/0090471 | A1 | 7/2002 | Burger et al. |
| 2002/0108327 | A1 | 8/2002 | Shaw |
| 2002/0177658 | A1 | 11/2002 | Tajima et al. |
| 2002/0189182 | A1 | 12/2002 | Record |
| 2003/0014936 | A1 | 1/2003 | Watanabe |
| 2003/0024192 | A1 | 2/2003 | Spargur |
| 2003/0029097 | A1 | 2/2003 | Albracht |
| 2003/0056458 | A1 | 3/2003 | Black et al. |
| 2003/0121225 | A1 | 7/2003 | Hunsaker |
| 2003/0131551 | A1 | 7/2003 | Mollinger et al. |
| 2003/0154664 | A1 | 8/2003 | Beck et al. |
| 2004/0003566 | A1 | 1/2004 | Sicuranza |
| 2004/0026021 | A1 | 2/2004 | Groh et al. |
| 2004/0142157 | A1 | 7/2004 | Melkonian |
| 2004/0172909 | A1 | 9/2004 | Gabbard et al. |
| 2004/0211141 | A1 | 10/2004 | Sandy |
| 2005/0081468 | A1 | 4/2005 | Wilson et al. |
| 2005/0102946 | A1 | 5/2005 | Stucky et al. |
| 2006/0005492 | A1 | 1/2006 | Yohnke et al. |
| 2006/0026920 | A1 | 2/2006 | Fairbanks et al. |
| 2006/0037268 | A1 | 2/2006 | Mahaffey |
| 2006/0042183 | A1 | 3/2006 | Benes |
| 2006/0053715 | A1 | 3/2006 | Mowery et al. |
| 2006/0053716 | A1 | 3/2006 | Mowery et al. |
| 2006/0053740 | A1 | 3/2006 | Wilson et al. |
| 2006/0068188 | A1 | 3/2006 | Morse et al. |
| 2006/0075712 | A1 | 4/2006 | Gilbert et al. |
| 2006/0156668 | A1 | 7/2006 | Nasvik |
| 2007/0011976 | A1 | 1/2007 | Mowery et al. |
| 2007/0044402 | A1 | 3/2007 | Hess |
| 2011/0154759 | A1 | 6/2011 | Wilson et al. |

FOREIGN PATENT DOCUMENTS

| | | | |
|---|---|---|---|
| CL | 3.856 | | 8/2001 |
| DE | 4 01 04 760.1 | | 5/2001 |
| EP | 1086 988 | A1 | 3/2001 |
| GB | 1068202 | | 5/1967 |
| GB | 2101944 | | 8/2001 |
| JP | 364001539 | A | 1/1989 |
| JP | 2141484 | A | 5/1990 |
| JP | 4189938 | A | 7/1992 |
| JP | 5147997 | A | 6/1993 |
| JP | 6008219 | A | 1/1994 |
| JP | 09141752 | A | 6/1997 |
| JP | 410018555 | A | 1/1998 |
| JP | 02001079951 | A | 3/2001 |
| KR | 321694 | | 3/2003 |
| PL | 4115 | | 7/2004 |
| WO | 9957392 | A1 | 11/1999 |
| WO | WO 00/55446 | | 9/2000 |
| WO | 02070248 | A1 | 9/2002 |
| WO | 02081399 | | 10/2002 |

OTHER PUBLICATIONS

Web site print outs from www.dupontdow.com, "Adhesives," Aug. 12, 2000, 3 pages.

Web site print outs from www.dupontdow.com, "Neoprene—Grades of Neoprene—AquaStikTM Water Based Polychloroprene." Aug. 12, 2000, 2 pages.

Web site print outs from www.dupontdow.com, "Neoprene—Grades of Neoprene—Neoprene Solid Grades for Solvent-Based Adhesives." Aug. 12, 2000, 2 pages.

"New Craneboard sold core siding redefines home exterior siding," Crane Performance Siding news release online, Mar. 20, 2001, 3 pages.

Weiker, Jim, "Crane puts new face on siding," The Columbus Dispatch, May 9, 2002, 3 pages.

Innovations for Living, "What Do I Look for in Quality Vinyl Siding?" Owens Corning, Nov. 9, 2002, 1 page.

Crane in the News, International Builders' Show Preview, Jan./Feb. 2003, 1 page.

Feirer, Mark, "Vinyl Siding, Love it or hate it, plastic is here to stay," This Old House Online, no date, 8 pages.

Web site print outs from: www.new-siding.com (Jul. 7, 2005 archived webpage).

Concrete Accessories & Rentals, Inc., "Stucco & EIFS line", web site print outs from www.concreteacc.com/eifs.asp, Jan. 5, 2005, printed May 30, 2006, 3 pages.

Finnemore, Melody, "A Growing Problem, Mold, water damage and accompanying litigation hamper building industry", web site print outs from www.construction.com/NewsCenter/Headlines/RP/20040901nw-1.asp, printed May 30, 2006, 3 pages, The McGraw-Hill Companies, Inc.

Raylite, web site print outs from www.diversifoam.com/raylite.htm,publication date not available, printed May 30, 2006, 3 pages.

Insulation Technology, Inc. web site print outs from www.insultech-eps.com, publication date not available, printed May 30, 2006, 10 pages.

* cited by examiner

BACKED PANEL AND SYSTEM FOR CONNECTING BACKED PANELS

This application is a continuation of U.S. application Ser. No. 13/221,391, filed Aug. 30, 2011, which is a continuation of U.S. application Ser. No. 11/233,929, filed Sep. 23, 2005, each of which is hereby incorporated by reference in its entirety.

BACKGROUND AND SUMMARY OF THE INVENTION

The present invention relates generally to panels and, more particularly, to a backed panel and a backed panel assembly. Examples of panels that may benefit from the present invention include siding panels, wall panels, and other similar, suitable, or conventional types of panels or components. U.S. Pat. No. 6,321,500 is hereby incorporated by reference as just one example of a panel that may benefit from the present invention. Although the present invention may be described herein primarily with regard to siding panels and wall panels, it is not intended to limit the present invention to any particular type of panel or component, unless expressly claimed otherwise.

In order to enhance the thermal insulation of building structures, one or more layers or panels of insulating material may be provided between a facing panel and a building structure. Known insulated siding systems exist in many different forms. A common problem with known insulated siding systems is the joint between the sides of adjacent siding units. Simply abutting siding units that are situated side-by-side may leave an unsightly gap that may be infiltrated by wind, rain, and insects. On the other hand, overlapping the siding panels of adjacent backed siding units may result in an uneven or raised seam as a result of the presence of the backing panels. A raised or uneven seam may also detract from the appearance of the siding and create a passage for the undesired transfer of air, moisture, and insects. In addition, a raised or uneven seam may increase the risk of oil canning of the siding panels as well as delamination of the siding units. Furthermore, overlapping the siding panels may cause breakage or other damage to the underlying backing panel, which compromises the functionality of the backing panel. Thus, to achieve the desired level of integration between adjoined backed paneling units, an improved system and method of forming a lapped joint between backed panels without interference of the backing panels is needed.

The present invention provides a backed panel and a system for connecting backed panels. An exemplary embodiment of the backed panel comprises a facing panel and a backing panel, wherein the backing panel has a groove, recessed portion, or any other suitable type of relief channel. An exemplary embodiment of the relief channel may be adapted to receive a side edge portion of a facing panel of an adjacent backed panel. By providing a space to receive a side edge portion of an adjacent facing panel, an exemplary embodiment of the present invention may enable an improved lap joint to be established between adjacent backed panels.

In addition to the novel features and advantages mentioned above, other features and advantages of the present invention will be readily apparent from the following descriptions of the drawings and exemplary embodiments.

DETAILED DESCRIPTION OF EXEMPLARY EMBODIMENT(S)

Figure 1:
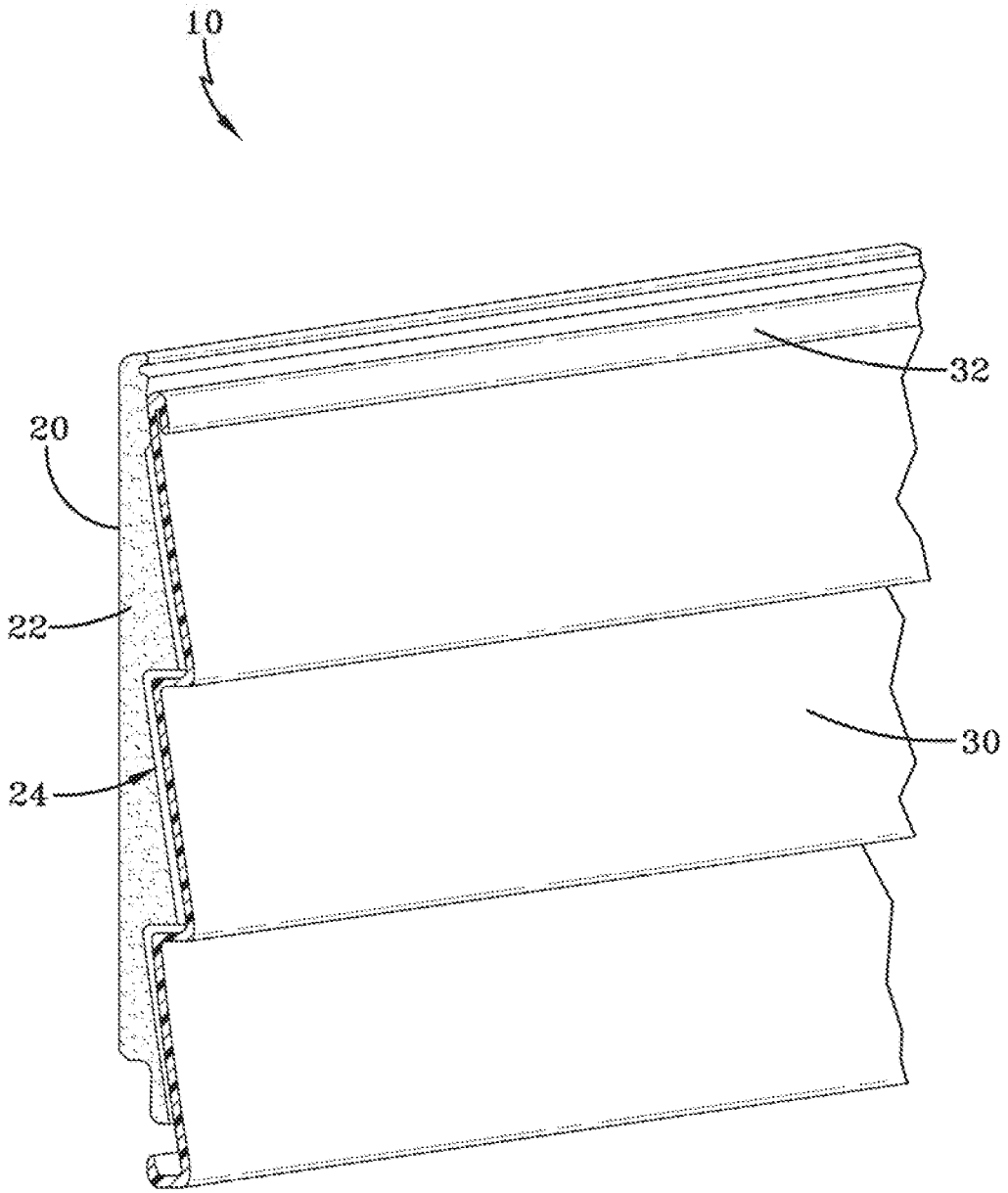
FIG. 1 is a partial perspective view of an exemplary embodiment of a backed panel of the present invention.

The present invention is directed to a backed paneling unit. In FIG. 1, an exemplary embodiment of a backed paneling unit 10 (e.g., a siding unit) includes backing panel or portion 20 and facing panel or portion 30 (e.g., a siding panel), which may optionally have an attachment flange 32. Side edge portion 22 of backing panel 20 includes a relief channel 24. Relief channel 24 may be a groove, channel, or any other suitable type of recessed portion. In particular, relief channel 24 is adapted to provide a gap or space between backing panel 20 and siding panel 30 for receiving a side edge portion of a siding panel of an adjacent siding unit. As a result, an exemplary embodiment of the present invention may enable the formation of an improved lap between adjacent backed paneling units.

Figure 2:
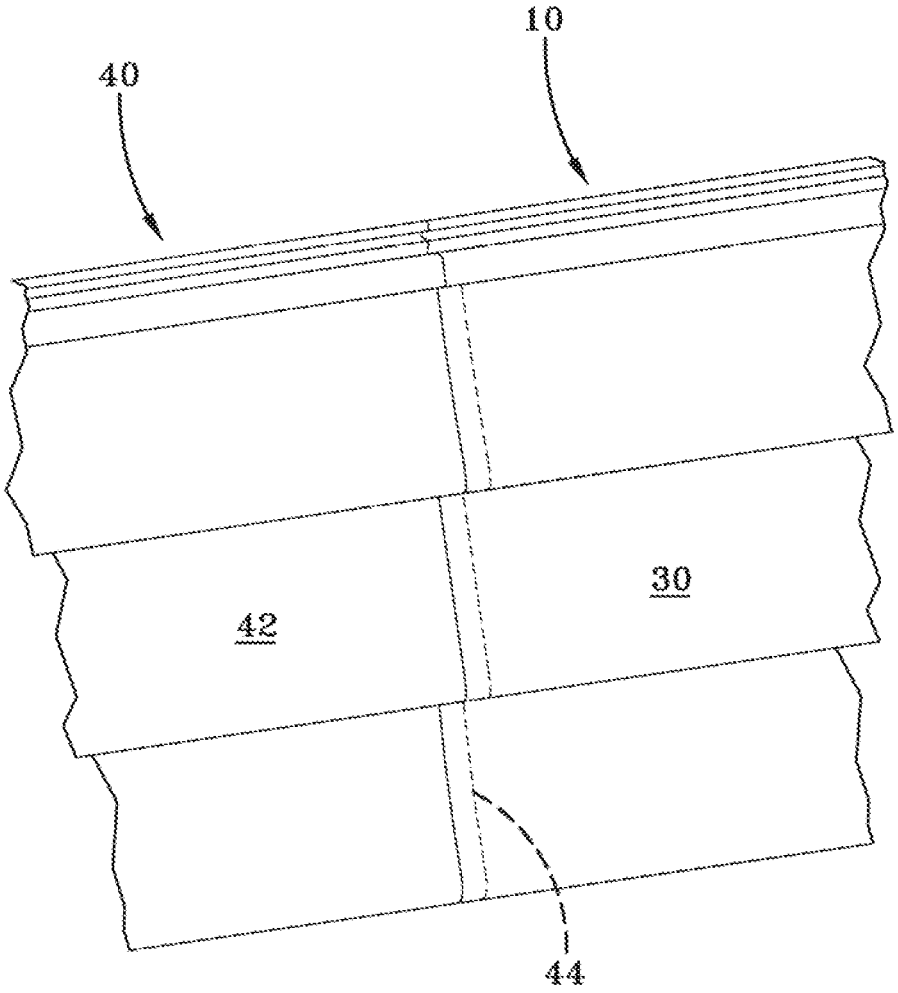
FIG. 2 is a partial perspective view of a panel assembly including the backed panel of FIG. 1.

FIG. 2 shows an example of an assembly including siding unit 10 of FIG. 1. In this example, a lap joint is formed between siding unit 10 and siding unit 40. In particular, a side edge portion 44 of siding panel 42 of siding unit 40 is inserted into the gap between backing panel 20 and siding panel 30 that is provided by relief channel 24. Side edge portion 44 of siding panel 42 is shown in phantom because it is overlapped by siding panel 30.

Due to relief channel 24, an exemplary embodiment of the present invention may enable the formation of an improved seam between backed panels that are located side-by-side. For instance, an exemplary embodiment of the present invention may enable the seam to be significantly smoother as compared to a backed panel system that does not include a relief channel in a backing panel. In other words, displacement of siding panel 30 by side edge portion 44 may be minimized because of relief channel 24. Thus, in addition to providing a seam that may be resistant to water, air, and insect infiltration, an exemplary embodiment of the present invention may enable the formation of a seam that may improve the appearance of a siding assembly and may also mitigate delamination and oil canning of a siding unit. Furthermore, relief channel 24 may also limit damage to backing panel 20. In particular, relief channel 24 creates a gap that facilitates the insertion of side edge portion 44 under siding panel 30 without damaging backing panel 20.

Backing panel 20 may be comprised of any suitable material. For example, backing panel 20 may be comprised of a foamed plastic (e.g., expanded or extruded polystyrene foam, polyurethane foam, or any other desired plastic foam material) or any other similar or suitable reinforcing or insulating material. In fact, it should be recognized that backing panel 20 may be comprised of any material having desired physical characteristics including, but not limited to, foam, fiberglass, cardboard, and other similar or suitable materials. Any suitable means may be used to obtain the shape of backing panel 20. In an exemplary embodiment, the shape of backing panel 20 may be obtained by molding (e.g., compression molding, injection molding, vacuum molding, or other similar or suitable types of molding), by extrusion through a predetermined die configuration, by cutting or machining such as with a power saw or other cutting devices, and/or by any other suitable method.

Siding panel 30 may be comprised of any suitable material. An exemplary embodiment of siding panel 30 may be formed from a polymer such as a vinyl material. Other materials such as polypropylene, polyethylene, other plastics and polymers, polymer composites (such as polymer reinforced with fibers or other particles of glass, graphite, wood, flax, other cellulosic materials, or other inorganic or organic materials), metals (such as aluminum or polymer coated metal), or other similar or suitable materials may also be used. The panel may be molded, extruded, roll-formed from a flat sheet, or formed by any other suitable manufacturing technique.

Backing panel 20, which may, for example, be used for panel stiffness, reinforcement, thermal insulation, noise mitigation, or reduction of oil canning, may be attached to the backside of siding panel 30. Attachment of the backing panel 20 to the siding panel 30 may be achieved using any desired attachment material. Examples of attachment materials include adhesives, glues, epoxies, polymers, tapes (pressure sensitive adhesive tapes), VELCRO, other hook and loop fastening materials, and other similar or suitable attachment materials. For example, an adhesive may be used to bond a portion of backing panel 20 to a portion of the inside of siding panel 30. In one exemplary embodiment, the attachment material may be flexible such that it may help to compensate for the expansion and contraction forces between backing panel 20 and siding panel 30, which may expand and contract at different rates.

Figure 3:
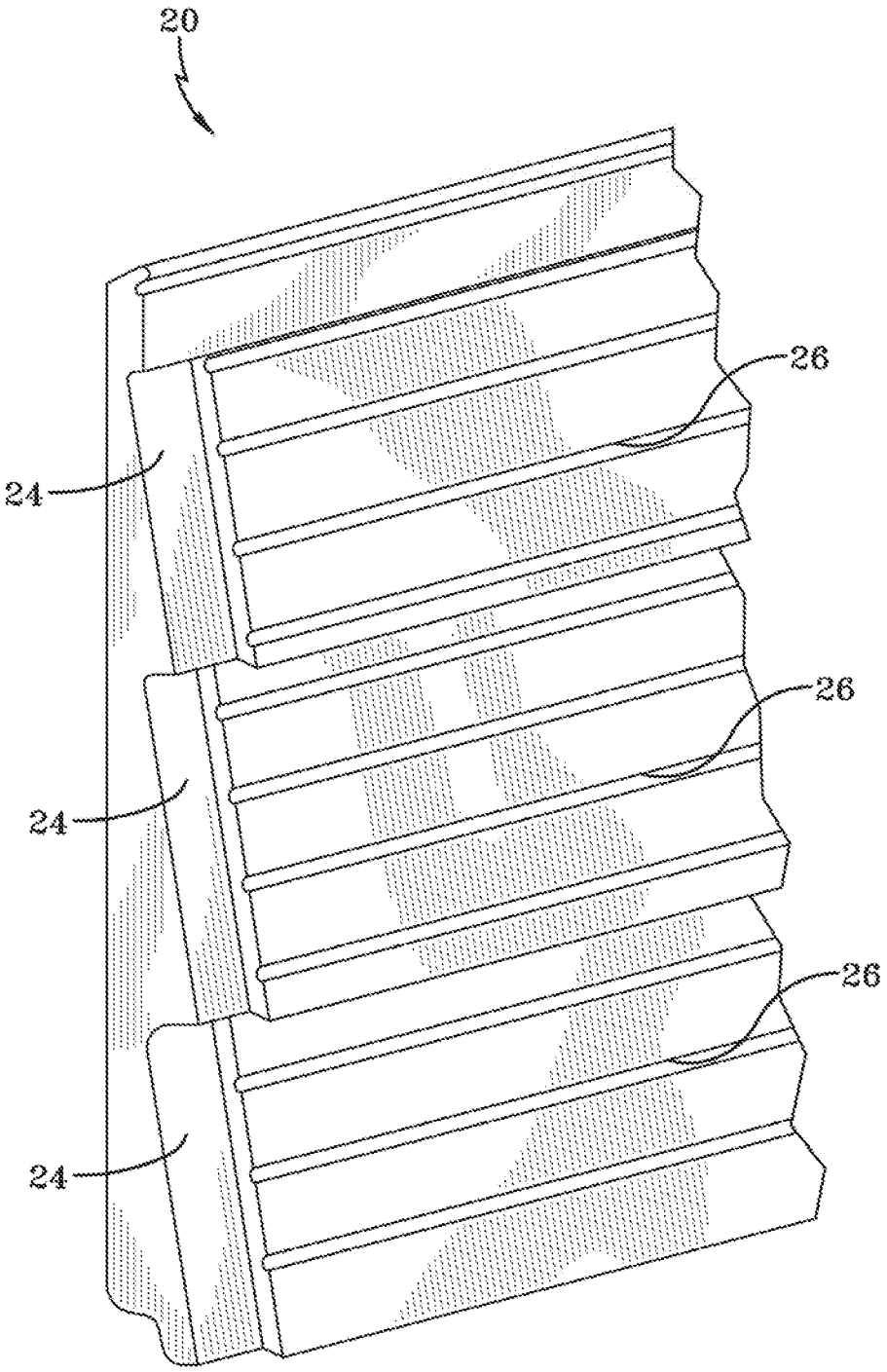
FIG. 3 is a partial perspective view of the backing panel of FIG. 1.

Optionally, such as shown in FIG. 3, backing panel 20 may include grooves 26 to enhance attachment of backing panel 20 to siding panel 30. Grooves 26 may provide space between backing panel 20 and siding panel 30 to accept and retain a desired quantity of an attachment material to promote attachment. Grooves 26 may be machined, extruded, molded, or imparted into backing panel 20 by any suitable method and in any desired direction(s). For example, grooves 26 may be selectively positioned to provide direction for optimal placement of the attachment material for attaching backing panel 20 to siding panel 30. In this example, grooves 26 extend in a generally horizontal direction substantially across the entire length of backing panel 20 to account for forces in the longitudinal direction of siding unit 10 caused by the different expansion and contraction properties of backing panel 20 and siding panel 30. Although grooves 26 stop at relief channel 24 in this example, grooves 26 may optionally extend through relief channel 24. Other variations are also possible. For example, in other exemplary embodiments of the present invention, grooves 26 may: only extend a limited distance; extend in a vertical, diagonal, or other desired direction; have a winding or other curvy shape; intersect with at least one other recess; and/or extend along any other desired direction.

Figure 4:
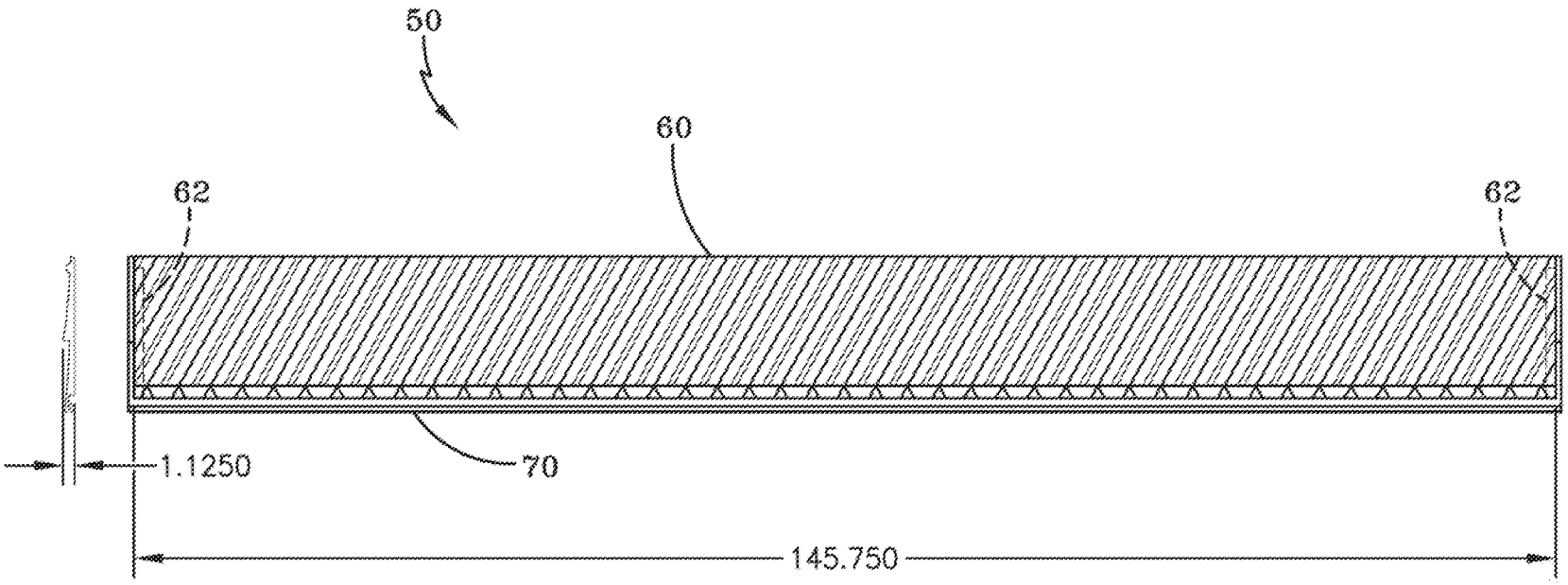
FIG. 4 is a rear elevation view of an exemplary embodiment of a backed panel of the present invention (approximate dimensions are given for the purpose of example only).
Figure 5:
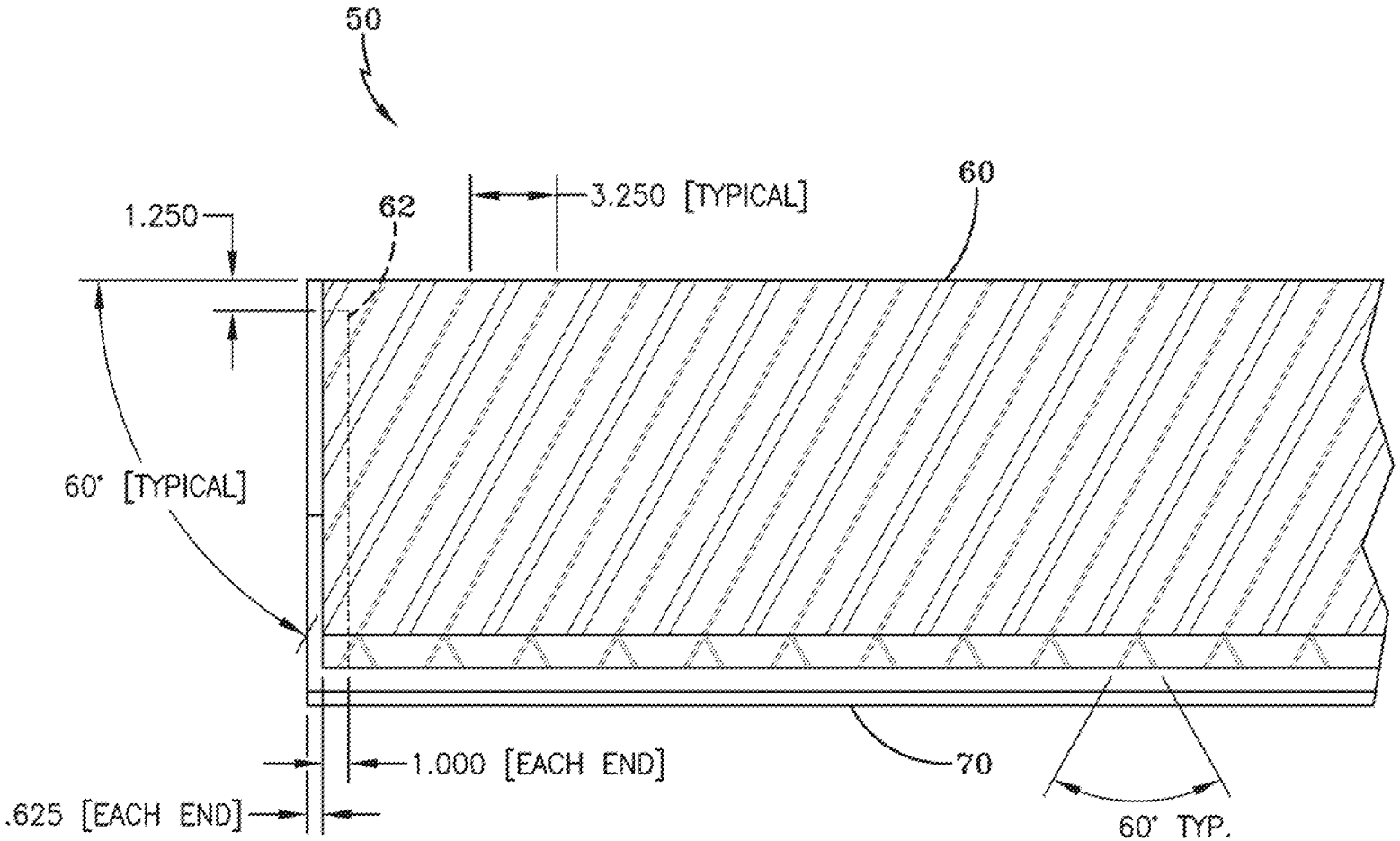
FIG. 5 is a partial rear elevation view of the backed panel of FIG. 4 (approximate dimensions are given for the purpose of example only).
Figure 6A:
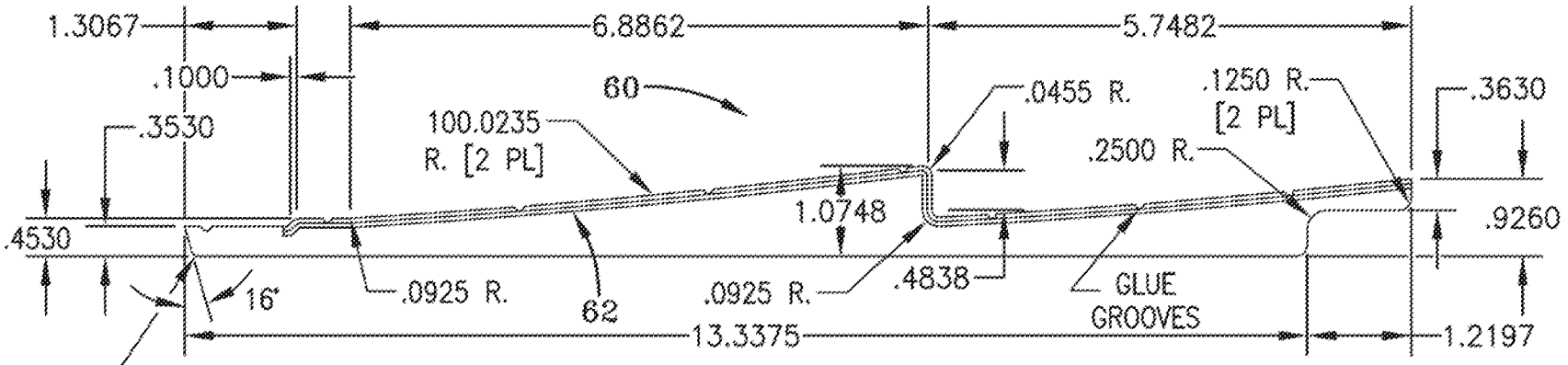
FIG. 6A is a side elevation view of the backing panel of FIG. 4 (approximate dimensions are given for the purpose of example only).
Figure 6B:
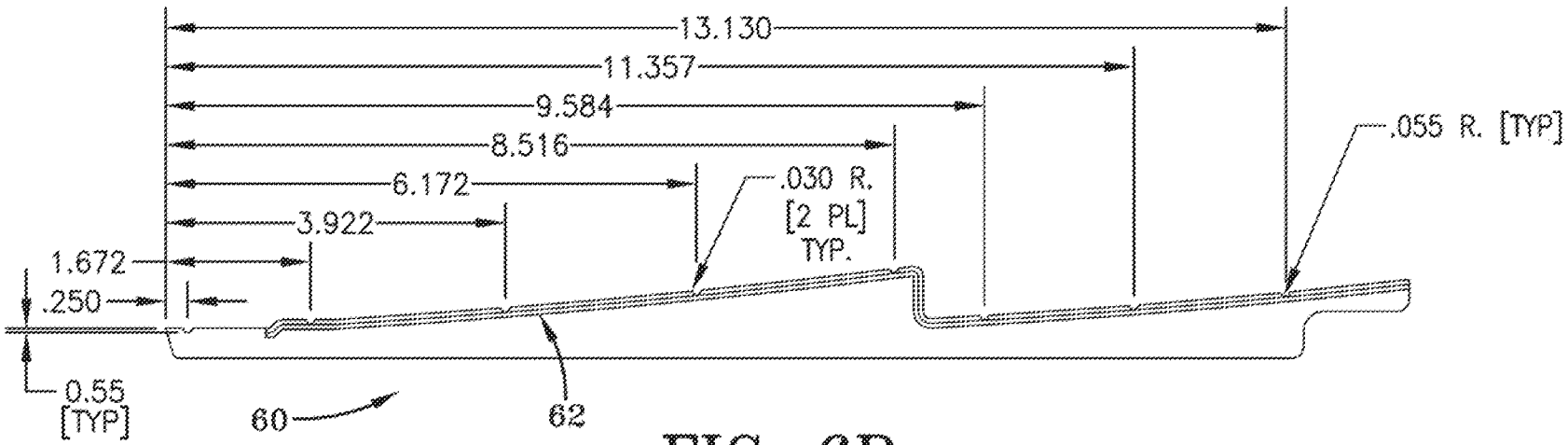
FIG. 6B is another side elevation view of the backing panel of FIG. 4 (approximate dimensions are given for the purpose of example only).

Referring now to the example shown in FIGS. 4 and 5, siding unit 50 is comprised of a backing panel 60 and a siding panel 70. Relief channels 62, which are shown in phantom, are provided on opposing side edge portions of backing panel 60 in this exemplary embodiment. However, in other exemplary embodiments of the present invention, a relief channel may optionally be provided on only one side edge portion. A relief channel 62 may extend along any desired portion of a side edge portion of backing panel 60. In this example, a relief channel may extend from the bottom of backing panel 60 up to a point approximately where backing panel 60 is proximate to an attachment flange of siding panel 70. FIG. 1 shows another example of this type of configuration. Nevertheless, it should be recognized that a relief channel of other exemplary embodiments may extend along a different portion of the side edge portion or along the entire side edge portion of the backing panel.

A relief channel 62 may have any suitable dimensions that enable it to receive an adjacent siding panel. In FIGS. 4 and 5, the dimensions, which are in inches, are provided merely as an example of one embodiment of the present invention. FIG. 5 is a detail of FIG. 4 showing exemplary dimensions of a relief channel 62. Optionally, such as shown in FIG. 5, backing panel 60 may be offset from the side edge of siding panel 70, which may also facilitate the formation of a lap joint with an adjacent siding unit. In this example, the offset may be about 0.625 inch. Nevertheless, it should be recognized that the optional offset may be any suitable or desired distance. Furthermore, as shown in FIG. 5, a relief channel 62 in this example may have a depth of about 1.0 inch. However, it should again be recognized that any suitable depth may be selected for relief channel 62 to enable it to receive an adjacent siding panel.

Figure 7:
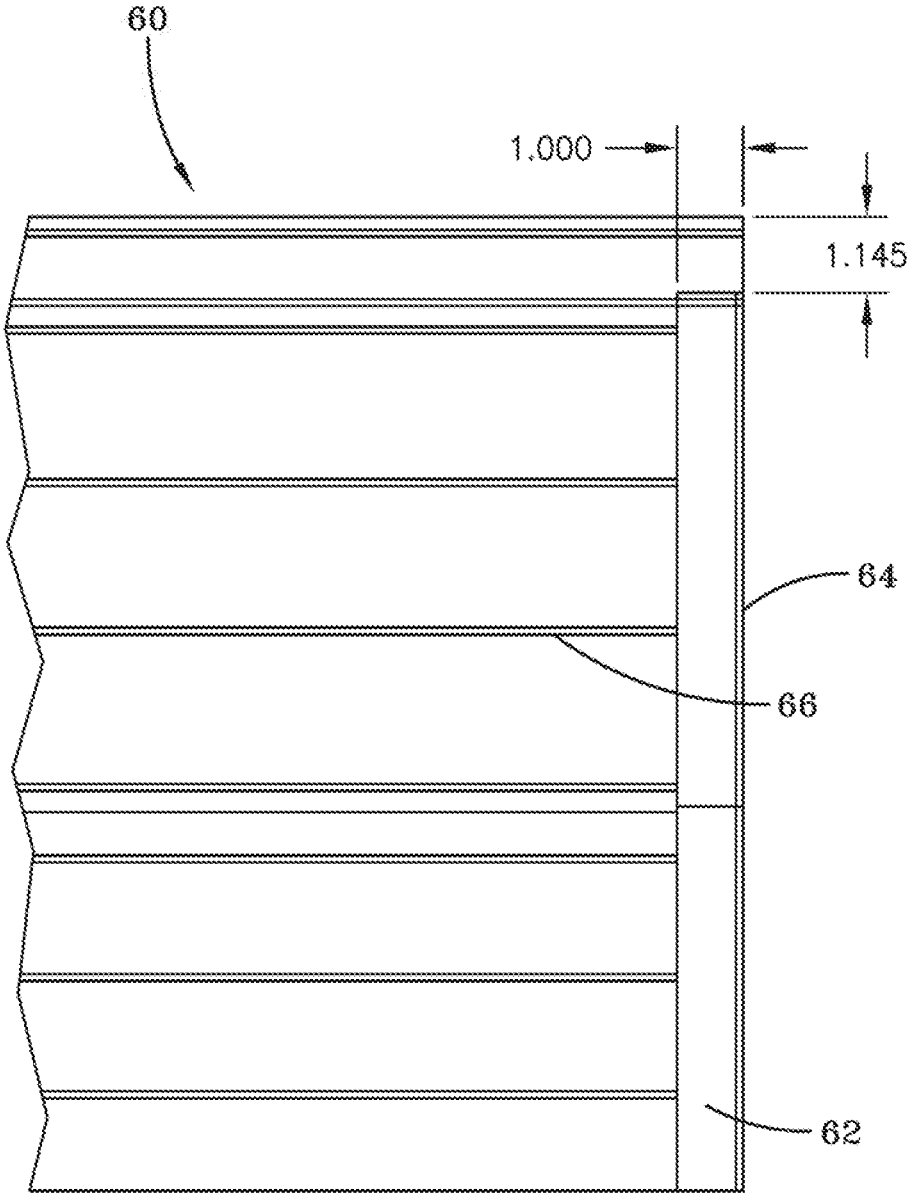
FIG. 7 is a partial front elevation view of the backing panel of FIG. 4 (approximate dimensions are given for the purpose of example only).
Figure 8:
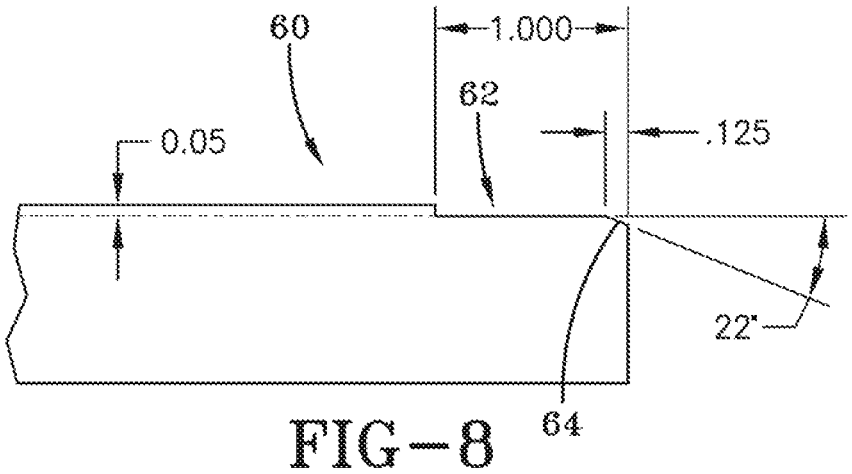
FIG. 8 is a partial bottom plan view of the backing panel of FIG. 4 (approximate dimensions are given for the purpose of example only).
Figure 9:
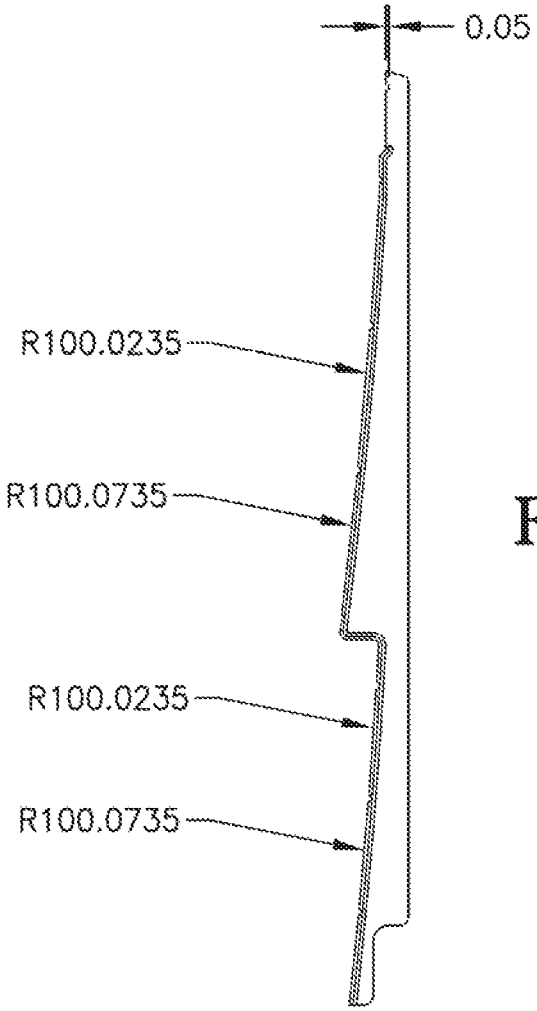
FIG. 9 is another side elevation view of the backing panel of FIG. 4 (approximate dimensions are given for the purpose of example only).

FIGS. 6A, 6B, 7, 8, and 9 illustrate further exemplary dimensions for backing panel 60. Again, it should be recognized that such dimensions are provided for illustrative purposes only and are not intended to limit the invention unless expressly claimed otherwise. FIG. 7 shows that relief channel 62 starts about 1.145 inches from the top edge of backing panel 60 in this exemplary embodiment. In addition, FIGS. 7 and 8 more clearly show the approximate 1.0-inch depth of relief channel 62 of this example, and FIGS. 8 and 9 show that the approximate width of this exemplary embodiment of relief channel 62 is about 0.05 inch. As shown in FIGS. 7 and 8, relief channel 62 may have a chamfer 64 along any portion of its side edge. In this example, chamfer 64 extends along the entire side edge of relief channel 62. Chamfer 64 may facilitate the insertion of an adjacent siding panel into relief channel 62. In addition, chamfer 64 may also help to limit damage to the side edge of relief channel 62, which could be caused the insertion of an adjacent siding panel into relief channel 62. A chamfer may have any suitable dimensions. In this example, chamfer 64 has a depth of about 0.125 inch, and it extends at about a 22-degree angle from the primary surface of relief channel 62. Other dimensions for chamfer 64 are possible and considered within the scope of the present invention. Backing panel 60 may also include optional grooves 66 such as shown in FIG. 7, which may provide space between backing panel 60 and siding panel 70 to accept and retain a desired quantity of an attachment material to promote attachment of backing panel 60 to siding panel 70. As shown in FIGS. 8 and 9, the profile of this exemplary embodiment backing panel 60 may have a slight radius curvature of about 100.0235 inches, whereas the radius curvature of relief channel 62 may be about 100.0735 in this example. The radius curvature of a backing panel and relief channel of the present invention may be selected to obtain the desired aesthetic, physical, and performance characteristics of the backing panel and overall siding unit.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A paneling system comprising:

a first paneling unit and a second paneling unit, each of said first paneling unit and said second paneling unit respectively comprising:

a) a siding portion; and b) a backing portion secured to said siding portion such that a gap is formed between said siding portion and said backing portion, said gap facilitated by a recess formed along an edge of said backing portion;

wherein said gap formed by said first paneling unit is configured to receive an edge of said siding portion of said second paneling unit to facilitate formation of a lap joint between said first paneling unit and said second paneling unit.

2. The paneling system of claim 1 wherein said backing portion is comprised of a foamed plastic.

3. The paneling system of claim 1 wherein said siding portion is a vinyl siding panel.

4. The paneling system of claim 1 wherein said siding portion is comprised of a plastic composite including cellulosic filler.

5. The paneling system of claim 1 wherein said recess extends along a major portion of said edge of said backing portion.

6. The paneling system of claim 1 wherein said recess extends along an entire edge of said backing portion.

7. The paneling system of claim 1 wherein said recess has a width of about 0.05 inch.

8. The paneling system of claim 1 wherein said recess has a depth of about 1.0 inch.

9. The paneling system of claim 1 wherein:

said recess extends along at least a major portion of said edge of said backing portion;

said recess has a width of about 0.05 inch; and said recess has a depth of about 1.0 inch.

10. The paneling system of claim 1 wherein said recess has a chamfer along a portion of its edge.

11. The paneling system of claim 1 wherein said first paneling unit is substantially similar to said second paneling unit.

12. The paneling system of claim 1 wherein said gap formed by said first paneling unit is configured to receive said edge of said siding portion of said second paneling unit to facilitate formation of a smoother lap joint between said first paneling unit and said second paneling unit as compared to a substantially similar paneling system that does not include said gap.

13. A paneling system comprising:

a first paneling unit and a second paneling unit, each of said first paneling unit and said second paneling unit respectively comprising:

(a) a siding portion having an attachment flange; and (b) a backing portion secured to said siding portion such that a gap is formed between said siding portion and said backing portion, said gap facilitated by a recess formed along an edge of said backing portion, said gap extending from a bottom edge of said backing portion up to a point approximately where said backing portion is proximate to said attachment flange of said siding portion;

wherein said gap formed by said first paneling unit is configured to receive an edge of said siding portion of said second paneling unit to facilitate formation of a lap joint between said first paneling unit and said second paneling unit.

14. The paneling system of claim 13 wherein said backing portion is comprised of a foamed plastic.

15. The paneling system of claim 13 wherein said siding portion is a vinyl siding panel.

16. The paneling system of claim 13 wherein said siding portion is comprised of a plastic composite including cellulosic filler.

17. The paneling system of claim 13 wherein said recess has a width of about 0.05 inch.

18. The paneling system of claim 13 wherein said recess has a depth of about 1.0 inch.

19. The paneling system of claim 13 wherein said recess extends along a major portion of said edge of said backing portion.

20. The paneling system of claim 13 wherein:

said recess has a width of about 0.05 inch;

said recess has a depth of about 1.0 inch; and said recess extends along a major portion of said edge of said backing portion.

21. The paneling system of claim 13 wherein said first paneling unit is substantially similar to said second paneling unit.

22. The paneling system of claim 13 wherein said gap formed by said first paneling unit is configured to receive said edge of said siding portion of said second paneling unit to facilitate formation of a smoother lap joint between said first paneling unit and said second paneling unit as compared to a substantially similar paneling system that does not include said gap.

23. A method for adjoining panels, said method comprising:

providing a first paneling unit and a second paneling unit, each of said first paneling unit and said second paneling unit respectively comprising:

a) a siding portion; and b) a backing portion secured to said siding portion such that a gap is formed between said siding portion and said backing portion, said gap facilitated by a recess formed along an edge of said backing portion; and inserting an edge of said siding portion of said first paneling unit into said gap formed by said second paneling unit to form a lap joint between said first paneling unit and said second paneling unit.

24. The method of claim 23 wherein said recess has a width of about 0.05 inch.

25. The method of claim 23 wherein said recess has a depth of about 1.0 inch.

26. The method of claim 23 wherein said recess extends along a major portion of said edge of said backing portion.

27. The method of claim 23 wherein:

said recess has a width of about 0.05 inch;

said recess has a depth of about 1.0 inch; and said recess extends along a major portion of said edge of said backing portion.

28. The method of claim 23 wherein said first paneling unit is substantially similar to said second paneling unit.

29. The method of claim 23 wherein said lap joint between said first paneling unit and said second paneling unit is smoother as compared to a lap joint of a substantially similar paneling system that does not include said gap.

30. The method of claim 23 wherein:

said siding portion has an attachment flange; and said gap extends from a bottom edge of said backing portion up to a point approximately where said backing portion is proximate to said attachment flange of said siding portion.

31. The method of claim 30 wherein said recess has a width of about 0.05 inch.

32. The method of claim 30 wherein said recess has a depth of about 1.0 inch.

33. The method of claim 30 wherein said recess extends along a major portion of said edge of said backing portion.

34. The method of claim 30 wherein:

said recess has a width of about 0.05 inch;

said recess has a depth of about 1.0 inch; and said recess extends along a major portion of said edge of said backing portion.

35. The method of claim 30 wherein said first paneling unit is substantially similar to said second paneling unit.

36. The method of claim 30 wherein said lap joint between said first paneling unit and said second paneling unit is smoother as compared to a lap joint of a substantially similar paneling system that does not include said gap.

* * * * *